US005790146A

United States Patent [19]

Anderson

[11] Patent Number: 5,790,146

[45] Date of Patent: Aug. 4, 1998

[54] FLUID APPLICATOR FOR MAINTENANCE OF LIQUID INK PRINTERS

[75] Inventor: David G. Anderson, Ontario, N.Y.

[73] Assignee: Xerox Corporation, Stamford, Conn.

[21] Appl. No.: 566,472

[22] Filed: Dec. 4, 1995

[51] Int. Cl.[6] ..... B41J 2/165

[52] U.S. Cl. ..... 347/28

[58] Field of Search ..... 347/28

[56] References Cited

U.S. PATENT DOCUMENTS

| | | | |
|---|---|---|---|
| 4,306,245 | 12/1981 | Kasugayama et al. | 346/140 R |
| 4,540,997 | 9/1985 | Biggs et al. | 346/140 R |
| 4,746,938 | 5/1988 | Yamamori et al. | 346/140 R |
| 4,814,794 | 3/1989 | Sato | 346/140 R |
| 4,853,717 | 8/1989 | Harmon et al. | 346/140 R |
| 4,855,764 | 8/1989 | Humbs et al. | 346/140 R |
| 4,947,187 | 8/1990 | Iwagami | 346/140 R |
| 5,126,752 | 6/1992 | Weinberg | 346/140 R |
| 5,128,690 | 7/1992 | Nozawa | 346/1.1 |
| 5,250,962 | 10/1993 | Fisher et al. | 346/140 R |
| 5,552,811 | 9/1996 | Kurata et al. | 347/28 |
| 5,574,485 | 11/1996 | Anderson et al. | 347/28 |
| 5,589,861 | 12/1996 | Shibata | 347/28 |
| 5,589,865 | 12/1996 | Beeson | 347/28 |

FOREIGN PATENT DOCUMENTS

| | | | |
|---|---|---|---|
| 0263689 | 4/1988 | European Pat. Off. | B41J 3/04 |
| 0621136 A2 | 10/1994 | European Pat. Off. | B41J 2/165 |
| 549333 | 8/1980 | Japan | B41J 3/04 |
| 63310905 | 6/1990 | Japan | B41J 2/175 |
| 2203994 | 11/1988 | United Kingdom | B41J 3/04 |

*Primary Examiner*—Jeffrey L. Sterrett

[57] ABSTRACT

A liquid ink printer includes a liquid ink printhead having a plurality of ink ejecting orifices and a fluid applicator adapted for movement across the liquid ink printhead for cleaning thereof. The fluid applicator includes a nozzle body defining a surface and an orifice wherein the surface and the orifice apply an accurately controlled amount of cleaning fluid to the liquid ink printhead for cleaning thereof. The fluid applicator includes a second body having a second surface adjacently located to the first located surface which aids in controlling the flow of cleaning fluid applied to the liquid ink printhead. The fluid applicator applies a thin film of fluid to the nozzle bearing surface of the liquid ink printhead which is then removed by a vacuum nozzle separated an optimized distance from the fluid applicator. The separation distance enables the applied maintenance fluid to adequately loosen any viscous plugs of partially dried ink and/or any contaminants found on the surface of the liquid ink printhead. Once the contaminants are sufficiently loosened by the application of the maintenance fluid, the vacuum nozzle vacuums away the contaminants and the applied maintenance fluid.

21 Claims, 5 Drawing Sheets

FLUID APPLICATOR FOR MAINTENANCE OF LIQUID INK PRINTERS

CROSS-REFERENCE TO RELATED APPLICATION

This application incorporates by reference pending U.S. patent application Ser. No. 08/391,326, filed Feb. 21, 1995, entitled "Wet-Wipe Maintenance Device For A Full-Width Ink-Jet Printer", which is a continuation of U.S. patent application Ser. No. 08/047,931 filed Apr. 19, 1993.

FIELD OF THE INVENTION

This invention relates generally to maintaining the proper operation of a liquid ink printer and more particularly to a fluid applicator for applying a maintenance fluid to a printhead of a liquid ink printer.

BACKGROUND OF THE INVENTION

An ink jet printer of the type frequently referred to as drop-on-demand, has at least one printhead from which droplets of ink are directed towards a recording medium. Within the printhead, the ink is contained in a plurality of channels. Piezoelectric devices or power pulses cause the droplets of ink to be expelled as required, from orifices or nozzles located at the end of the channels. In thermal ink jet printing, the power pulses are usually produced by resistors also known as heaters, each located in a respective one of the channels. The heaters are individually addressable to heat and vaporize the ink in the channels. As a voltage is applied across a selected heater, a vapor bubble grows in that particular channel and ink bulges from the channel nozzle. At that stage, the bubble begins to collapse. The ink within the channel retracts and then separates from the bulging ink thereby forming a droplet moving in a direction away from the channel nozzle and towards the recording medium whereupon hitting the recording medium a spot is formed. The channel is then refilled by capillary action which, in turn, draws ink from a supply container of liquid ink. Operation of a thermal ink jet printer is described in, for example, U.S. Pat. No. 4,849,774.

The ink jet printhead may be incorporated into either a carriage type printer or a page width type printer. The carriage type printer typically has a relatively small printhead containing the ink channels and nozzles. The printhead is usually sealingly attached to a disposable ink supply cartridge and the combined printhead and cartridge assembly is attached to a carriage which is reciprocated to print one swath of information (equal to the length of a column of nozzles) at a time on a stationary recording medium, such as paper or a transparency. After the swath is printed, the paper is stepped a distance equal to the height of the printed swath or a portion thereof so that the next printed swath is overlapping or contiguous therewith. The procedure is repeated until the entire page is printed. In contrast, the pagewidth printer includes a stationary printhead, also known as a printbar, having a length sufficient to print across either the entire width or length of the recording medium. The recording medium is continually moved passed the pagewidth printhead in a direction normal to the length of the printhead and at a constant or varying speed during the printing process. A pagewidth ink jet printer is described in U.S. Pat. No. 5,192,959.

It has been recognized that there is a need to maintain the ink ejecting nozzles of an ink jet printhead, for example, by periodically cleaning the orifices when the printhead is in use, and/or by capping the printhead when the printer is out of use or is idle for extended periods of time. The capping of the printhead is intended to prevent the ink in the printhead from drying out. There is also a need to prime a printhead before use, to insure that the printhead channels are completely filled with ink and contain no contaminants or air bubbles and also periodically to maintain proper functioning of the orifices. Maintenance and/or priming stations for the printheads of various types of ink jet printers are described in, for example, U.S. Pat. No. 4,855,764, U.S. Pat. No. 4,853,717 and U.S. Pat. No. 4,746,938. Removal of gas from the ink reservoir of a printhead during printing is described in U.S. Pat. No. 4,679,059.

It has been found that to properly maintain an ink jet printhead two separate operations must be performed. In a first operation, a maintenance assembly is typically used to maintain proper condition or operation of the printhead nozzles by priming the nozzles, by wiping clean the nozzle face of the printhead, or by vacuuming the face of the printhead to remove any contaminants or ink which may have collected thereon. The second operation is to cap the printhead if the printhead nozzles will be exposed to air for extended periods of time to thereby prevent the ink contained in the nozzles from drying out. To prevent drying, a cap is brought into contact with a printhead to form a substantially airtight seal with the face of the printhead and around the nozzles.

Various methods and apparatus for maintaining the condition of ink jet printheads, including cleaning and capping of ink jet printheads are illustrated and described in the following disclosures which may be relevant to certain aspects of the present invention.

In U.S. Pat. No. 4,306,245 to Kasugayama et al., a liquid jet recording device provided with a cleaning protective means for cleaning and protecting an orifice is described. The cleaning protective means is provided at a reset position lying at one end of the scanning shaft of the device.

U.S. Pat. No. 5,128,690 to Nozawa, describes an ink jet apparatus comprising an ink jet head having plural discharge openings for discharging ink. A partial cap member, which can cover at least one of the discharge openings, is connected to a pressure source that can supply sufficient pressure through the covered discharge openings to force any foreign matter into a common liquid chamber. A liquid flow is created in the common chamber to flush the foreign matter from the ink jet head.

U.S. Pat. No. 5,250,962 to Fisher et al., describes a movable priming station for use with an ink jet printer having a printhead with a linear extended array of nozzles. The movable priming station includes a support capable of moving along the extended array of nozzles and a vacuum tube having a vacuum port adjacent to one end thereof. The support is controlled so that the vacuum port does not contact the nozzle containing surface of the printhead when the support is moved along the linear array of nozzles.

U.K. Patent Application GB2203994 to Takahashi et al., describes an applicator for applying antiwetting compositions to the nozzle bearing face of a printhead of an ink drop printer. The printhead which reciprocates across the face of a platen is moved to one end of the platen where the applicator is placed. The applicator includes an extendable pad which wipes the face of the printhead.

European Patent Application 0263689 to Funk, et al., describes a fluid applicator head in which fluid is to be ejected though a plurality of nozzle orifices by means of pressure pulses or by valve means which control the flow of fluid. The applicator head is flushed out by passing a flushing fluid through the nozzle orifices in which the applicator head is adapted to be moved from a position of applying droplets of fluid to a substrate and to a flushing position at which the nozzle orifices engage with a flushing member so that flushing fluid can flow through the nozzle orifices or conduits associated therewith.

European Patent Application 0621136 to Claflin et al., describes a wet wipe maintenance device for a full width ink jet printer. A shuttle is adapted to travel on a track through a fixed path parallel to an array of nozzle openings defined in a surface of a printhead. Mounted on the shuttle are an applicator for applying a liquid to the nozzle openings and a vacuum device for applying suction to the nozzle openings. The applicator is a wick of urethane felt through which water is supplied.

Japanese Patent Application 54-9333 to Kobayashii describes a device for cleaning discharge orifices of an ink jet recording head. When the recording head moves to a print scanning region, the recording medium liquid adhering around the discharge orifices is rubbed off by a liquid absorber fitted in a rubbing-off port adjacent to a recovery port.

Japanese Patent Application No. 63-310905 Abstract describes an ink jet recorder including a capping mode in which a cap body is brought into contact with a nozzle of a recording head so as to hermetically seal the nozzle. In a recovery mode, the cap body and a vacuum pump communicate with each other to return the recording head to a normally operative condition.

SUMMARY OF THE INVENTION

In accordance with one aspect of the present invention, there is provided a liquid ink printer comprising a liquid ink printhead including a surface having arranged thereon a plurality of ink ejecting orifices and a fluid applicator, adapted for movement across the liquid ink printhead, including a body defining a surface and an orifice, the surface and the orifice cooperating to apply a cleaning fluid to the liquid ink printhead for cleaning thereof.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
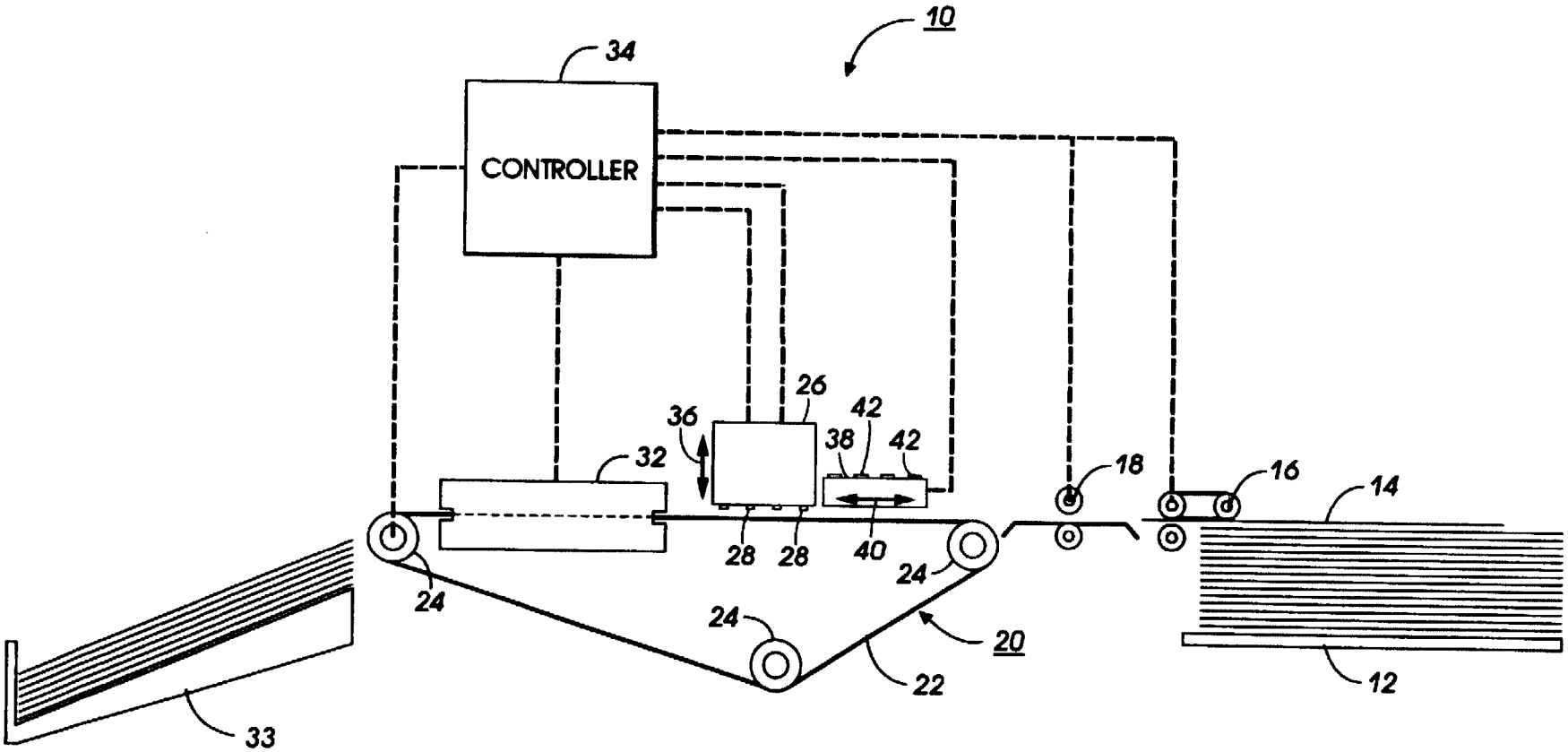
FIG. 1 is a schematic elevational view of an ink jet printer incorporating the present invention.

FIG. 1 illustrates a schematic elevational view of a liquid ink printer 10, for instance, an ink jet printer, of the present invention. The liquid ink printer 10 includes an input tray 12 containing sheets of a recording medium 14 to be printed upon by the printer 10. Single sheets of the recording medium 14 are removed from the input tray 12 by a pickup roller 16 and fed by feed rollers 18 to a transport mechanism 20. The transport mechanism 20 moves the sheet by a feed belt or belts 22 driven by rollers 24 beneath a liquid ink printbar assembly 26. The printbar assembly 26 includes one or more pagewidth printbars 28 supported in a printing position by a printhead support (not shown) in a confronting relation with the belt 22. During printing, the pagewidth printbars 28 deposit liquid ink on the recording medium 14 as it is carried by the belt 22 beneath the plurality of printbars 28. Each of the pagewidth printbars 28 includes an array of print nozzles, for instance, staggered or linear arrays, having a length sufficient to deposit ink in a printzone across the width of the recording medium 14. The present invention is equally applicable, however, to printers having partial width array ink jet printheads. The printbar assembly 26 also includes an ink supply either attached to the printhead support or coupled to the pagewidth printheads through appropriate supply tubing.

The recording medium 14 is then carried by the belt 22 through a dryer 32 for drying the liquid ink thereon. The dryer 32 can be a microwave dryer or other known types of dryers generating sufficient heat energy to dry the liquid ink which has been deposited upon the recording medium 14. If, however, the dryer 32 is a microwave dryer, the belt 22 is preferably made of a material substantially transparent to microwave power and having a relatively low dielectric constant. After the sheet is substantially dry,the sheet is deposited in an output tray 33.

If the dryer 32 is a microwave dryer, ink specially formulated to be heated by microwave power is preferably used. Such ink may include compounds designed to couple with the microwave power for increasing the amount of heat conducted thereby. One such compound is an ionic compound at least partially ionizable in the liquid vehicle. U.S. Pat. No. 5,220,346, entitled "Printing Processes with Microwave Drying", assigned to Xerox Corporation, discloses a suitable ink.

A controller 34 controls the operation of the transport mechanism 20, which includes the pickup roller 16, the feed roller 18 and the drive rollers 24. In addition, the controller 34 controls the movement of the printbar assembly 26, printing by the printbars 28, and operation of the dryer 32, as would be understood by one skilled in the art. The controller 34 can also include a plurality of individual controllers, such as microprocessors or other known devices dedicated to perform a particular function.

At the completion of a printing operation or when otherwise necessary, such as during a power failure, the printbar assembly 26, which is movable in the directions of an arrow 36, is moved away from the belt 22 such that a capping assembly 38, movable in the directions of the arrow 40, is moved beneath the printbar assembly 26 for capping thereof. Once the cap assembly 38 is positioned directly beneath the printbar assembly 26, the printbar assembly 26 is moved towards the belt 22 and into contact with a plurality of capping gaskets 42 located on the cap assembly 38.

The cap assembly 38 includes one or more of the capping gaskets 42 which engage or contact the page width printbars on an area surrounding one or more of the printbars to thereby seal the printbar nozzles from exposure to air. Suitable capping elements include those described later herein or those which compress to make a satisfactory seal.

This substantially airtight seal prevents the ink contained in the nozzles from drying out to thereby prevent clogging of the individual printbar nozzles. U.S. patent application Ser. No. 08/347,735 to Anderson et al. filed Dec. 1, 1994, entitled "Capping Element for Maintaining Ink Jet Printheads", assigned to Xerox Corp., describes a suitable capping element and is herein incorporated by reference. Once a capping operation is complete, the printbar assembly 26 moves away from the belt 22 and the cap assembly 38 moves away from the printbar assembly 26 such that the printbar assembly 26 can be positioned appropriately with respect to the belt 22 for printing on the recording sheets 14. In addition to the cap assembly 38, the ink jet printer 10 includes a maintenance assembly 44 (not shown in FIG. 1) but illustrated in FIG. 2.

Figure 2:
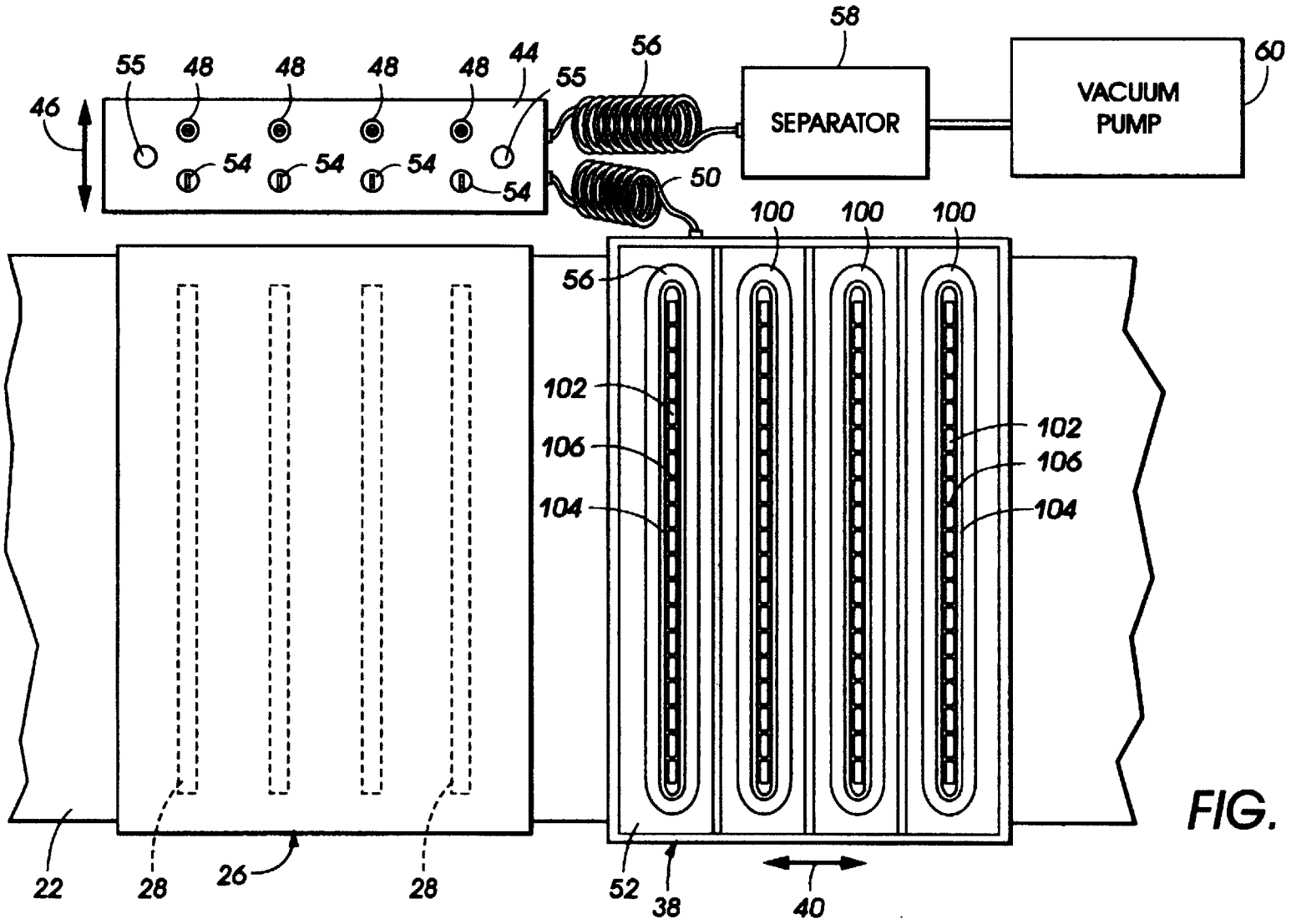
FIG. 2 is a schematic plan view of a cap assembly and a maintenance assembly for use in maintaining the proper operation of the illustrated print bar assembly.

FIG. 2 illustrates a plan view of the ink jet printer 10 showing the belt 22, the printbar assembly 26, the cap assembly 38, and the maintenance assembly 44. As previously described, the cap assembly 38 moves in the directions of arrow 40 to cap the individual printbars 28. In addition to the cap assembly 38, however, the maintenance assembly 44 moves in the directions of an arrow 46 for maintaining the nozzles of the printbars 28 when the printbar assembly 26 is sufficiently distanced from the belt 22 to enable the maintenance assembly 44 to move between the belt 22 and the printbar assembly 26.

The maintenance assembly 44 provides two functions, that of (1) wiping the front face of the ink jet printbars and (2) vacuuming the front face of the ink jet printbars to remove any debris or ink which has coagulated inside the individual nozzles. The maintenance assembly 44 includes a plurality of wet wiper nozzles 48 which receive a supply of maintenance fluid, such as water, over a fluid line 50 coupled to the cap assembly 38. The cap assembly 38 stores the maintenance fluid in a housing 52 which can be made of any number of materials, but typically is made from a moldable plastic. The interior of the housing 52 defines a cavity for holding the maintenance fluid. The maintenance fluid travels through the maintenance line 50 to supply an amount of the maintenance fluid or cleaning liquid to each of the individual wet wiping nozzles 48. The purpose of the wet wiping nozzles 48 is to apply maintenance fluid to the front face of the printbars 28 and to reprime (i.e., replenish the liquid ink supply) within the channels of the printbars.

The maintenance assembly 44 also includes a plurality of vacuum nozzles 54, each of which is coupled to a vacuum line 56 connected to a separator 58 which is, in turn, coupled to a vacuum pump 60. The vacuum pump 60 supplies a predetermined amount of vacuum through the separator 58 so that the vacuum nozzles 54 can apply vacuum to the front face of the printbar and, in particular, to the ejecting orifices thereof.

In one method of operation, the maintenance assembly 44 is first moved across the individual printbars so that the vacuum nozzles 54 apply a vacuum to the ink ejecting orifices of the printbars in succession. The maintenance assembly includes a follower 55 which contacts the printbars 28 or printbar assembly 26 to space the wet wiping nozzles 48 and vacuum nozzles 54 from the orifices. This step removes larger particles such as lint and paper fibers from the front face of the printbar. Preferably, the vacuum through the vacuum nozzles 54 is more than one order of magnitude greater than the typical negative pressure experienced by ink in a channel while a particular ejector is not being used. The preferred range for the vacuum at the vacuum nozzle is about 4 to 10 pounds per square inch (psi) at the nozzle tip. The typical back-pressure for retaining ink within a channel of the printbars 28 is between about a negative 0.03 and negative 0.15 (psi). In this initial vacuuming step, it is acceptable that the vacuum nozzles remove 10 to 20 channel-length volumes of ink or about 0.002 to 0.004 microliters of material from each channel to clean the channel. In this way, every ejector in the full width printbar will be thoroughly cleaned of plugs.

After the maintenance assembly has moved across the front face of the printbars 28, the direction of the maintenance assembly is reversed such that the wet wiper nozzles 48 precede the vacuum nozzles 54 in the direction of travel. As the wet wiper nozzles 48 move across the front face of the printbars 28, the wet wiper nozzles 48 apply a small quantity of maintenance fluid to the front face of the individual printbars obtained from the housing 52 of the capping assembly 38. According to a preferred embodiment of ink jet printbars, the front face includes a hydrophobic surface, preferably fluorinated carbon DLC ("diamond-like" coating), which causes the applied fluid to bead on the front face. The wet wiper nozzles 48 include enough outward pressure to cause a small quantity of water to bridge from the wet wiper nozzles to the front face of the printhead without causing undue "weeping" of excess water. A preferred range for outward water pressure from the wet wiper nozzles 48 for meniscus wiping is between about 0.015 and 0.075 psi. The maintenance fluid applied by the maintenance apparatus 44 restores a necessary amount of relative humidity to the area around the ink ejecting orifices. This relative humidity is helpful in, for example, decreasing the likelihood of plugs of dry ink forming too quickly within the ink ejecting orifices. Further, the maintenance fluid may have diluted therein a relatively small amount of detergent, which may be useful in removing certain kinds of dirt and/or other debris from the front face of the printbars. Following the application of the maintenance fluid, the printbar is almost immediately vacuumed again by the vacuum nozzles 54 which follow the wet wiper nozzles 48. This step is helpful in restoring the priming of available liquid ink within the channels immediately before printing resumes.

Figure 3:
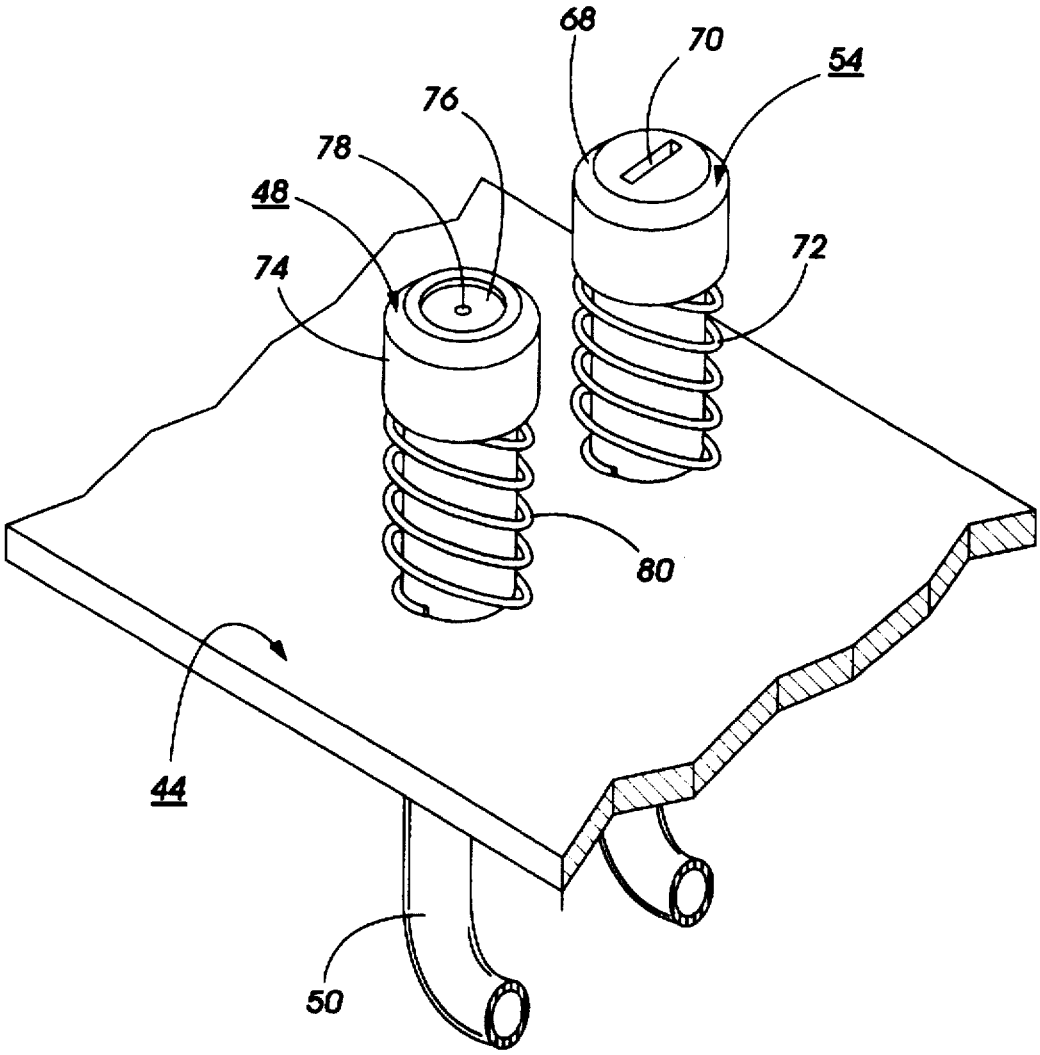
FIG. 3 is a perspective view of a wet wiper nozzle and a vacuum nozzle of the present invention.

FIG. 3 illustrates a portion of the maintenance assembly 44 including the wet wiper nozzle 48 and the vacuum nozzle 54. The vacuum nozzle 54 is preferably in the form of a small dome 68 having a slit-like orifice 70 defined therein and oriented to follow the direction of the linear array of orifices in the printbar 28. The orifice 70 is adapted to encompass a subset of nozzles in the array of the printbar at a given time as the maintenance assembly 44 moves across the printbars. The outer surface of the vacuum nozzle 54, as well as the follower 55, is preferably of a low friction plastic material such as teflon impregnated Delrin A/F (basically, teflon fibers dispersed in aceytl resin). The vacuum nozzle 54 is slidably held and spaced from the maintenance assembly 44 and includes a spring 72 located therebetween. The vacuum nozzle 54 slidably fits within the maintenance assembly 44 and the spring 72 helps to maintain the spacing of the vacuum nozzle 54 from the printbar during a vacuuming operation. The spring 72 is useful, however, if excessive debris is found on the printbars or if the surface of the printbars includes an irregular surface. Since the vacuum nozzle 54 is not fixed, the nozzle will move to thereby prevent damage to the printbar and nozzles.

The wet wiper nozzle 48 applies a predetermined amount of cleaning liquid or maintenance fluid, such as water containing a biocide, to the front face of the printbar to loosen any contaminants such as lint and paper fibers and also to loosen any viscous plus of partially dried ink which can form in the orifices of the printbar. Once the contaminants are properly loosened by the application of the maintenance fluid, the vacuum nozzle 54 vacuums away the contaminants including the applied maintenance fluid.

The wet wiper nozzle 48 includes a dome like structure 74 also made of a low-friction plastic material such as Delrin A/F, or other hydrophobic materials, and a nozzle body 76 which includes an orifice 78 receiving maintenance fluid from the housing 52 over the maintenance line 50. The wet wiper 48 is slidably held within the maintenance assembly 44, as previously described for the vacuum nozzle 54, and includes a spring 80 for biasing the wet wiper nozzle to provide movement if necessary for the reasons previously described.

Figure 4:
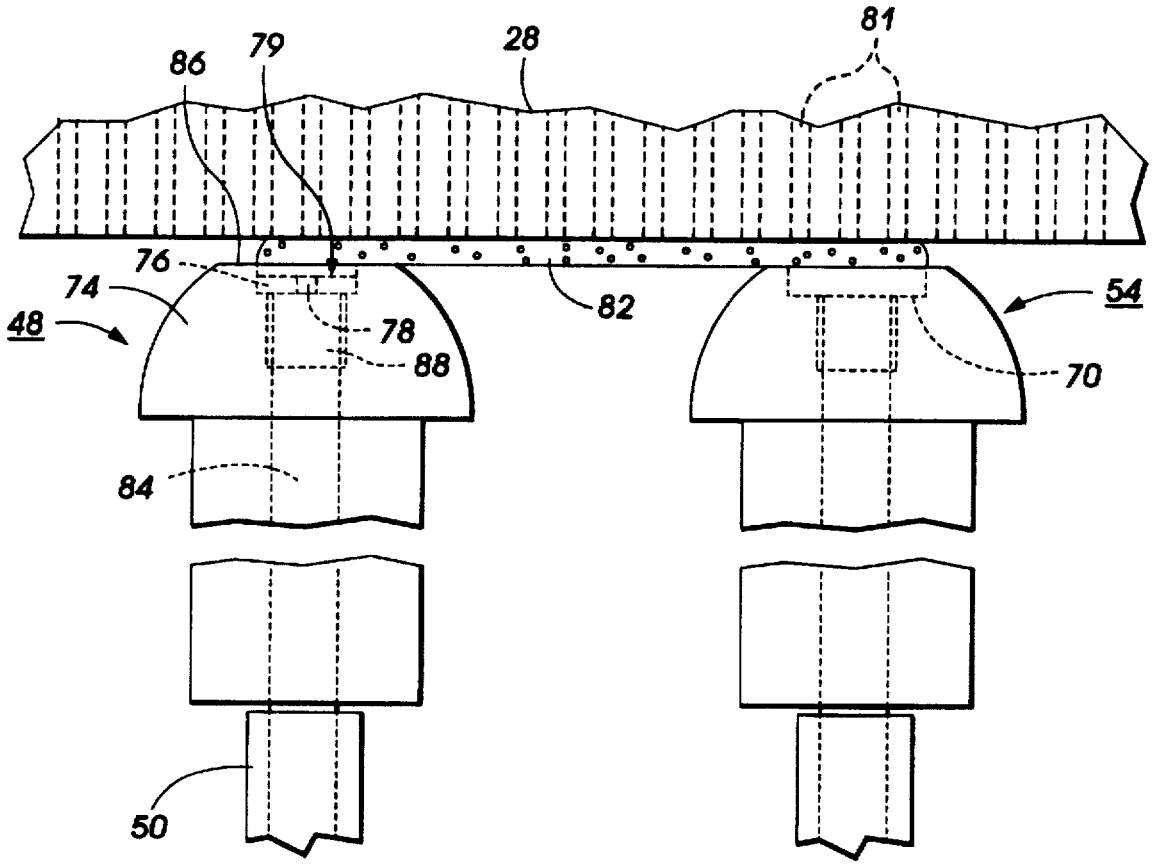
FIG. 4 is a sectional side view of a wet wiper applying maintenance fluid to an ink jet printhead and a vacuum nozzle removing the applied fluid therefrom.

FIG. 4 is a sectional side view of the wet wiper applying maintenance fluid to one of the ink jet printbars 28, having nozzles 81, and the vacuum nozzle 54 removing the applied fluid and contaminants. The nozzle body 76, the orifice 78, and the dome structure 74 act in concert to generate an accurately controlled body of water at a substantially planar surface 79 of the nozzle body 76. The body of water generated at the surface 79 is a nonturbulent body having a concave meniscus when the wet wiper nozzle 48 is stationary. When the wet wiper nozzle 48 moves across the face of the printbar however, a film of maintenance fluid 82 is placed on the surface of the printbar. This film of fluid provides for the necessary a wetting of the contaminants found on the surface of the printbar so that any contaminants are sufficiently lifted from or at least loosened from the face of the printbar. After the fluid has remained on printbar for a certain period of time, determined by the spacing between the wet wiper 48 and the vacuum nozzle 54, and the speed of travel thereof, the vacuum nozzle 54 vacuums away the fluid including any contaminants. It is possible to optimize the spacing between the wet wiper 48 and the vacuum nozzle 54 such that the maintenance fluid 82 remains on the printbar for an optimal period of time for proper cleaning of the surface.

A preferred range of spacing between the wet wiper nozzles 48 and the associated vacuum nozzle 54 is approximately from 5 to 30 millimeters. A preferable range of speed of travel for the maintenance assembly 44 is from approximately 10 to 80 millimeters/second. This speed enables the maintenance fluid to remain on the printbar for a period of time ranging from approximately 0.062 seconds to 3 seconds. It has been found that a preferable spacing between nozzles is approximately 10 millimeters and the speed of travel approximately 50 millimeters/second.

In order to assure the correct thickness and width of the film of fluid 82, it has been found that parameters such as the fluid pressure applied to the meniscus wiper, the diameter of the orifice 78, the outside diameter of the surface 79 of the nozzle body 76, the wet wiper to vacuum spacing, and the external shape of the meniscus, are important. It has also been found that as the hydrophobicity of the wet wiper nozzle changes, so does the amount of wetting of the surface of the dome structure 74. It is, therefore, necessary to properly control the size and shape of the generated body of water. Consequently, the present invention includes the nozzle body 76, made of one material, pressed into an aperture 84 of the structure 74, made of another material.

The nozzle body 76 is preferably formed of a high energy material, such as stainless steel, so that the maintenance fluid which flows through the fluid line 50 adequately wets the stainless steel material to accurately form the body of water located thereon. In addition to the nozzle body 76 being made of a high energy material, the nozzle body 76 is slightly recessed from a surface 86 of the dome structure 74 which aids in the formation of the water body. This distance is preferably approximately 0.02" to 0.04". It has also been found that the amount of water pressure necessary to create the body of water at the nozzle body 76 is approximately between 2/10 to 1" inch of water, which can be generated by maintaining the elevation of the maintenance housing 52, the necessary distance above the elevation of the wet wiper nozzles 48. In addition, it can also be seen that the nozzle body 76 includes a channel 88 defined therein which is much larger than the orifice 78 to thereby restrict the flow of fluid received from the maintenance housing 52. The orifice 78 should be at least one millimeter in diameter and is preferably between 0.004 to 0.020 inches. Based on these parameters defining the structure of the wet wiper nozzle 48, it has been found that the spacing distance between the surface 86 of the dome structure 78 and the nozzle bearing surface of the printbar 28 is approximately between 0.004 to 0.020".

Figure 5:
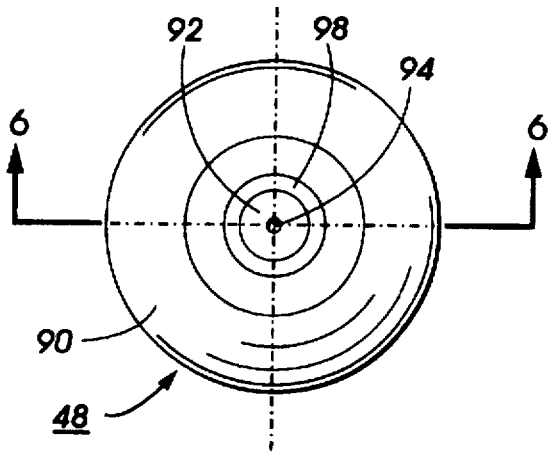
FIG. 5 is a plan view of another embodiment of the wet wiper of the present invention.
Figure 6:
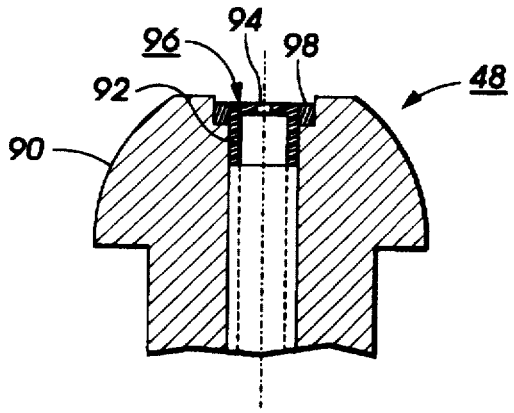
FIG. 6 is a sectional side view of the wet wiper of the present invention along a line 6—6 of FIG. 5.

FIG. 5 is a plan view of another embodiment of the wet wiper nozzle 48 of the present invention. In this embodiment, the wet wiper nozzle 48 includes a dome structure 90 made of any suitable engineering plastic (preferably a hydrophobic material), such as Delrin A/F, as described for the dome structure 74 of the embodiment of FIG. 4. A nozzle body 92 is inserted into an aperture of the dome structure 90 and includes an orifice 94 similar in dimension to the previously described orifice 78 (See also FIG. 6). The nozzle body structure 92 includes a substantially planar surface 96 to enable the formation of the body of water having an accurately controlled meniscus of the present invention. In this embodiment, however, the nozzle body 92 is made of a material, such as nylon, and a high energy band of material 98 surrounds the nozzle body 92. The high energy band of material 98, such as a stainless steel sleeve, helps to define the location of the outer edge of the body of water at the interface between the high energy band 98 and the dome structure 90. In the embodiment shown, the precision plastic nozzle body 92 is pressed into the stainless steel sleeve 98 and the combination is fitted into the dome structure 90.

Once a print job is completed, the cap assembly 38 moves into position to cap the individual printbars 28 as previously described. The cap assembly 38 includes a plurality of capping gaskets 100 (see FIG. 2), each of which is securely attached to the housing 52. The capping gaskets are aligned on the housing 52 such that a plurality of orifices 102 formed in the housing 52 are substantially aligned with each of the capping gaskets 100 and apertures defined therein. The orifices 102 provide for the venting or transfer of moisture which evaporates from the maintenance fluid contained in the housing 52 such that each of the orifices 102 in combination with the surrounding capping gasket 56 creates a humidity chamber for humidifying the linear array of ink ejecting orifices on the front face of the printbars 28.

When the capping assembly 38 is positioned for capping, the printbar assembly 26 is moved into contact with the capping gaskets 100 to sightly compress each one to form a substantially airtight seal. Each of the capping gaskets include a contacting ridge 104 which contacts the front face of the printbars. Recessed beneath the surface of the contacting ridge 104 is a plurality of individual ribs 106 which provide structure and support for the side walls of the capping gaskets 100. The ribs 106 prevent the aperture 102 from being closed off so that the ink ejecting orifices can remain properly humidified during a capping operation.

In recapitulation, there has been provided a fluid applicator for the maintenance of a liquid ink printer. The fluid applicator of the present invention is a device which provides for the generation of an accurately controlled film of fluid applied to the nozzle bearing surface of a printhead for the removal of contaminants found thereon. In addition, a vacuum nozzle follows the fluid applicator by an optimized distance to allow for the loosening of any viscous plugs or other contaminants from the surface of the printhead. It is, therefore, apparent that there has been provided in accordance with the present invention, a fluid applicator for the maintenance of a liquid ink printer that fully satisfies the aims and advantages hereinbefore setforth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A liquid ink printer comprising:

a liquid ink printhead; and a fluid applicator, adapted for movement across said liquid ink printhead, including a first body defining a first surface and an orifice, the first surface and the orifice cooperating to apply a cleaning fluid to the liquid ink printhead for cleaning thereof, said fluid applicator including a second body defining a second surface, the second surface adjacently located to the first surface, controlling the application of the cleaning fluid applied to said liquid ink printhead, with the first surface being recessed with respect to the second surface.

2. The liquid ink printer of claim 1, wherein the surface area of the first surface is larger than the orifice.

3. The liquid ink printer of claim 2, wherein said first body comprises a high energy material.

4. The liquid ink printer of claim 3, wherein the aperture is substantially centrally located in the first surface of said first body.

5. The liquid ink printer of claim 4, wherein the first surface of said first body is substantially planar.

6. The liquid ink printer of claim 5, wherein the first surface of said first body defines an outer perimeter substantially circular in dimension.

7. The liquid ink printer of claim 6, wherein said first body comprises a hydrophilic material tending to hold a fluid applied thereto.

8. The liquid ink printer of claim 7, wherein said second body comprises a hydrophobic material tending to repel a fluid applied thereto.

9. The liquid ink printer of claim 8, wherein said first body comprises a metal material.

10. The liquid ink printer of claim 1, comprising a cleaning fluid supply coupled to the orifice, supplying cleaning fluid to the orifice for transfer to the surface of said first body.

11. The liquid ink printer of claim 10, wherein said first body defines a channel coupled to the orifice, the channel terminated by the orifice for restricting the flow of cleaning fluid through the channel.

12. The liquid ink printer of claim 11, wherein the channel includes a dimension substantially perpendicular to the flow of fluid therethrough being greater than a dimension of the orifice being substantially perpendicular to the flow of fluid therethrough.

13. The liquid ink printer of claim 1, wherein the second surface comprises a high energy material.

14. The liquid ink printer of claim 13, wherein said first body comprises a hydrophobic material tending to repel a fluid applied thereto.

15. The liquid ink printer of claim 14, wherein the second surface defines an inner perimeter substantially circular in dimension.

16. The liquid ink printer of claim 15, wherein said second body comprises a hydrophilic material tending to repel a fluid applied thereto.

17. The liquid ink printer of claim 1, wherein the surface of said first body includes an area greater than a dimension of the orifice substantially perpendicular to the flow of fluid therethrough.

18. The liquid ink printer of claim 17, wherein the first surface is substantially planar.

19. The liquid ink printer of claim 18, wherein the first surface defines an outer perimeter substantially circular in dimension.

20. The liquid ink printer of claim 19, wherein the aperture is substantially centrally located in the first surface.

21. The liquid ink printer of claim 20, wherein said first body comprises a hydrophilic material tending to hold a fluid applied thereto.

* * * * *

UNITED STATES PATENT AND TRADEMARK OFFICE
CERTIFICATE OF CORRECTION

PATENT NO. : 5,790,146

DATED : August 4, 1998

INVENTOR(S) : David G. Anderson et al.

It is certified that error appears in the above-identified patent and that said Letters Patent is hereby corrected as shown below:

TITLE PAGE:

In [75], second inventor, Alfred J. Clafin, Ontario, N.Y. has been added.

Signed and Sealed this

Nineteenth Day of January, 1999

*Attest:*

*Acting Commissioner of Patents and Trademarks*

*Attesting Officer*